United States Patent [19]

Wagner, III et al.

[11] Patent Number: 4,533,415

[45] Date of Patent: Aug. 6, 1985

[54] HIGH ENERGY PROPELLANT

[75] Inventors: Frederick B. Wagner, III, R.D. #2, Margarete Dr., Box 679, Elmer, N.J. 08318; Anthony J. Izbicki, Reading, Pa.

[73] Assignee: Frederick B. Wagner, III, Elmer, N.J.

[21] Appl. No.: 836,887

[22] Filed: Sep. 23, 1977

[51] Int. Cl.[3] ..... C06B 35/00

[52] U.S. Cl. ..... 149/35; 149/92; 149/93; 149/109.6

[58] Field of Search ..... 149/35, 92, 93, 109.6

[56] References Cited

U.S. PATENT DOCUMENTS 3,879,504 4/1975 Sherman et al. ..... 149/35 X 3,977,924 8/1976 McCullock ..... 149/35 X

*Primary Examiner*—Stephen J. Lechert, Jr.

*Attorney, Agent, or Firm*—Synnestvedt & Lechner

[57] ABSTRACT

A high energy propellant or explosive charge is prepared by compacting a normally pulverulent secondary high explosive, such as HMX or RDX, and retaining the pulverulent material packed as a coherent mass by means of a bridging agent capable of hydrogen bonding with the secondary explosive. The bridging agents used in this invention are characterized in their ability to hydrogen bond to the secondary explosive, their comparatively high intrinsic density, their solubility in a polar solvent, and their stereo compatibility with the secondary high explosive. The bridging agents are also characterized by the presence of at least two sites for hydrogen bonding comprised of hydroxyl or, carboxyl groups.

20 Claims, No Drawings

HIGH ENERGY PROPELLANT

BACKGROUND OF THE INVENTION

This invention relates to the preparation of propellants and explosive charges having high specific impulse and high detonation velocities. More particularly, it relates to the utilization of secondary high explosives such as Beta-HMX and RDX which are physically similar in that they exist only in pulverulent form and chemically similar in that they have pendant nitro groups as part of their molecular configuration. While it should be understood that this invention relates broadly to these types of secondary high explosives, the invention is discussed with particular reference to Beta-HMX (cyclotetramethylenetetranitramine) because of its high density and superior detonation velocity and pressure, although it is not intended that the invention should be so limited.

Beta-HMX is a known secondary high explosive having a high density, high specific impulse and high detonation velocity. While its relatively high cost, as compared, for example, to TNT, has limited the uses to which it has been applied, it has assumed considerable importance in the space program where the release of high bursts of energy are required. The need for such a propellant will become even greater as the space quest moves toward planets such as Venus and Jupiter which, due to their dense atmospheres that are several orders of magnitude greater than Earth's, require the development of substantial kinetic energy in order to effect course corrections, the powering of retro rockets, and the like.

While HMX is one of the better detonating propellants, it suffers from the fact that it can only be made in pulverulent form and cannot be melted and cast, as can TNT, into a compact, coherent mass or charge. To solve this problem, the use of numerous binders has been proposed to secure the HMX particles in a matrix of the binder. The binding materials known to the prior art are deficient in that they may limit the density to which the HMX can be compacted and, by so doing, observably reduce the specific impulse and detonation velocity. In order to minimize this problem, binders comprised of other energetic explosive materials, such as nitrocellulose, have been tested, but even these cause a measurable diminution in the specific impulse and detonation velocity of the HMX.

OBJECTS OF THE INVENTION

Accordingly, it is an object of this invention to provide a propellant comprised of a pulverulent secondary explosive, such as HMX, which can be compacted into a high-density, coherent mass without materially reducing the specific impulse or detonation velocity.

Another object of this invention is to provide a coherent mass of a normally pulverulent energetic secondary high explosive into which a more sensitive secondary and/or primary high explosive is incorporated to facilitate detonation.

DETAILS OF THE INVENTION

Briefly, these and other objects of this invention are achieved by compacting a normally pulverulent secondary high explosive of high specific impulse and high detonating velocity into a high-density charge and securing the pulverulent material together as a coherent mass by means of an organic bridging agent which causes hydrogen bonding. The preferred secondary high explosives, as mentioned above, have pendant nitro groups, and include Beta-HMX and RDX.

In selecting a bridging agent suitable for use in the practice of this invention, the most important criterion is that it be capable of hydrogen bonding. This requires that the molecule of the bridging agent have two or more hydrogen-active sites which preferably are selected from the groups consisting of hydroxyl and, carboxyl. As it is desirable to obtain maximum hydrogen bonding per unit volume, the bridging agent is desirably of relatively low molecular weight.

Second, the bridging agent should have a high intrinsic density for an organic compound—i.e., in excess of about 1.2, and preferably even more closely approaching the intrinsic density of the HMX which is about 1.9. As has been recognized, a high density is important so as not deleteriously to affect the intrinsic detonation properties of the HMX and particularly not to adversely affect the rate of propogation of the reaction and continuity of the propogation of the reaction.

Third, from a practical standpoint, in order to obtain the desired hydrogen bonding, it is desired that the bridging agent be soluble in a polar solvent which most conveniently is a lower alcohol.

Fourth, the stereo chemistry of the bridging agent should be such that its hydrogen bonding sites are not sterically hindered or hindered by intramolecular hydrogen bonding so that at least one hydrogen bond site can attach to a hydrogen bond site on the surface of the HMX particle while leaving another site on the HMX particle free to hydrogen bond with the hydrogen-active site on another bridging agent. Stated differently, the bridging agent should be configured so that it can bridge between the HMX and other bridging molecules.

In the practice of this invention, it is convenient to dissolve the bridging agent in a polar solvent such as isopropyl alcohol and then thoroughly wet out the secondary high explosive with this solution. The resulting slurry is compacted into an appropriate shape at high pressure (e.g., 10,000 psi) and the alcohol evaporated from the compact. Charges made in this manner have sufficient strength to be handled without crumbling and the effect of including the bridging agent, when properly selected, has only slight, if any, adverse effect upon the detonation characteristics such as impulse and velocity of the secondary high explosive.

The amount of bridging agent that is added to link the secondary high explosive powder together can vary considerably and good results can be obtained in a range of from 5 to 10 wt.% bridging agent, and, it is believed, as little as 2 wt.% and as much as 20 wt.% are useful. As a general proposition, it would seem that as the weight percent of the bridging agent is increased, the strength of the compacted secondary explosive will increase, but this increased strength will be accompanied by a loss in specific impulse and detonating velocity. Thus, the amount of bridging agent selected for any given application is a balance between the amount of strength required forthe charge and the reduction in specific impulse and detonating velocity that can be tolerated.

Secondary high explosive charges prepared in accordance with this invention are of considerable stability and have long shelf life. As they are not easily detonated, it may sometimes be convenient to use them in combination with a primary or sensitive secondary high explosive to facilitate initiation of the explosive charge. One convenient method for accomplishing this is to include a more sensitive secondary explosive (e.g., PETN) and/or a primary explosive, such as lead azide, in the mixture of the secondary high explosive and the bridging agent to permit detonation by means of lasers such as are now carried aboard spacecraft for other purposes. By mixing the lead azide or sensitive secondary high explosive uniformly throughout the charge, detonation can be achieved without regard to the orientation of the charge to an emitted laser beam. Depending upon the activity of the primary and/or secondary high explosive desired, the proper amount can be selected as, for example, from 2 to 15 wt.% of the primary or more sensitive secondary explosive.

In the following examples, a Heath Schlumberger Model SM-102A was used to calculate the actual detonation velocities of Beta-HMX and mixtures of Beta-HMX and hydroquinone used as the bridging agent. Hydroquinone was chosen because it so well meets the desired criteria set forth above. It has a high intrinsic density (1.36), it has two hydroxyl groups for hydrogen bonding, and it has stereo compatibility with HMX. The detonation time measuring apparatus works on the principle that when a high explosive detonates, the high temperatures and pressures create a plasma or conductive zone. This conductive zone completes a circuit between two ionization probes and starts the timer in the SM-102A unit. When the conductive zone that is generated by the detonation reaches a second set of ionization probes located at a precise distance downstream from the first set of probes, a circuit is completed that stops the timer. From the known distance between the two sets of ionization probes and the time the detonation wave takes to move the known distance, the detonation velocity of the explosive in feet per second can be determined.

EXAMPLES 200 drops of reagent-grade isopropyl alcohol was mixed with 5 grams of technical-grade hydroquinone. 45 grams of Beta-HMX was worked into this mixture over a period of about fifteen minutes.

The above mixture was then pressed into pellets at a pressure in excess of about 10,000 psi to achieve minimum densities of at least 1.65. (Theoretical density for Beta-HMX is 1.9.) After the pellets were so formed, they were allowed to dry for approximately 48 hours under low humidity conditions to permit volatilization of the alcohol.

As a control, 100% Beta-HMX was pressed in a cylindrical mold at pressures of about 10,000 psi and contained at an apparent density of 1.644. The pure Beta-HMX was detonated while contained in the cylinder and the detonation velocity was compared with those of the modified HMX pellets. Two samples were evaluated at each concentration of hydroquinone shown in the following table.

| Explosive Charge | Density | Computed Detonation Velocity (meters/sec) | Computed Detonation Pressure (K bar) |
|---|---|---|---|
| 100% Beta-HMX | 1.64 | 8,200 | 290 |
| 95% Beta-HMX and 5% hydroquinone | 1.65 | 8,080 | 275 |
| 95/5% as above | 1.78 | 8,500 | 315 |
| 90% Beta-HMX and | 1.65 | 7,900 | 260 |

-continued

| Explosive Charge | Density | Computed Detonation Velocity (meters/sec) | Computed Detonation Pressure (K bar) |
|---|---|---|---|
| 10% hydroquinone 90/10% as above | 1.78 | 8,300 | 305 |

In the above examples, the explosive charges that contained the hydroquinone were coherent pellets that did not readily crumble, whereas the unmodified HMX, when pressed at the same pressures, retained its powder characteristic. As can be seen, incorporation of the hydroquinone into the HMX did not observably alter the detonation velocity or the detonation pressure, at least when compressed to a density of 1.78.

Examples of other bridging agents that are believed to be useful in the practice of this invention include:

| Molecule | Intrinsic Density |
|---|---|
| Oxalic acid | 1.65 |
| Maleic acid | 1.59 |
| Terephthalic acid | 1.51 |
| Pyrocatechol | 1.37 |

While the above listing is far from exhaustive, it is a representative sampling of bridging agents which are reasonably available at reasonable costs and which meet the criteria of high density, stereo compatibility and difunctionality with hydroxyl or carboxyl groups. Additionally, it may be suggested that other bridging agents meeting these criteria which are generally classified as clathrates may prove useful in the practice of this invention.

We claim:

1. A high energy propellant comprising a normally pulverulent secondary high explosive held together as a cohesive mass by means of a bridging agent which is a clathrate having a plurality of hydrogen-active sites.

2. A propellant according to claim 1 wherein the high explosive molecules have pendant nitro groups.

3. A propellant according to claim 2 wherein the high explosive is Beta-cyclotetramethylenetetranitramine or cyclotrimethylenetrinitramine.

4. A propellant according to claim 1 wherein the bridging agent has an intrinsic density greater than about 1.2.

5. A propellant according to claim 1 wherein the bridging agent is soluble in a polar solvent.

6. A propellant according to claim 1 wherein the bridging agent and the explosive have stereo compatibility.

7. A propellant according to claim 4 wherein the hydrogen-active sites are hydroxyl or carboxyl groups.

8. A propellant according to claim 1 wherein the bridging agent is present in an amount from about 2 wt.% to about 20 wt.%.

9. A propellant according to claim 8 wherein the bridging agent is present in an amount from about 5 wt.% to about 15 wt.%.

10. A propellant according to claim 1 wherein a primary or more sensitive secondary explosive is included in the mixture.

11. A propellant according to claim 10 wherein the primary or more sensitive secondary explosive are present in an amount of from about 2 wt.% to about 15 wt.%.

12. A propellant according to claim 10 wherein the primary explosive is lead azide.

13. A propellant according to claim 10 wherein the more sensitive secondary explosive is petaerythritoltetranitrate.

14. A propellant according to claim 1 wherein the bridging agent is hydroquinone.

15. A method for the preparation of an explosive charge comprising the steps of mixing a major portion of a pulverulent secondary high explosive having pendant nitro groups with a minor portion of a bridging agent and compacting the mixture to form a shaped coherent mass.

16. A method according to claim 15 wherein the explosive is Beta-cyclotetramethylenetetranitramine and the bridging agent is hydroquinone.

17. A propellant mixture according to claim 1 wherein the bridging agent is oxalic acid.

18. A propellant mixture according to claim 1 wherein the bridging agent is maleic acid.

19. A propellant mixture according to claim 1 wherein the bridging agent is terephthalic acid.

20. A propellant mixture according to claim 1 wherein the bridging agent is pyrocatechol.

* * * * *